US011365550B2

(12) United States Patent
Kensap

(10) Patent No.: US 11,365,550 B2
(45) Date of Patent: Jun. 21, 2022

(54) SMOOTHENING PAD FOR AN APPLICATOR FOR SEALANTS

(71) Applicant: OKEI MEISTRID OU, Kehtna Vald (EE)

(72) Inventor: Silver Kensap, Kaerepere Village (EE)

(73) Assignee: OKEI MEISTRID OU, Kehtna Vald (EE)

( * ) Notice: Subject to any disclaimer, the term of this patent is extended or adjusted under 35 U.S.C. 154(b) by 0 days.

(21) Appl. No.: 16/647,779

(22) PCT Filed: Aug. 7, 2018

(86) PCT No.: PCT/IB2018/055932
§ 371 (c)(1),
(2) Date: Mar. 16, 2020

(87) PCT Pub. No.: WO2019/016785
PCT Pub. Date: Jan. 24, 2019

(65) Prior Publication Data

US 2020/0232234 A1 Jul. 23, 2020

(30) Foreign Application Priority Data

Jul. 20, 2017 (EE) ..... P201700027

(51) Int. Cl.
*B05C 11/00* (2006.01)
*E04F 21/165* (2006.01)
(Continued)

(52) U.S. Cl.
CPC ..... *E04F 21/1652* (2013.01); *B05C 17/0052* (2013.01); *B05C 17/00503* (2013.01); *B05C 17/00596* (2013.01); *B05C 17/10* (2013.01)

(58) Field of Classification Search
CPC ..... E04F 21/1621; E04F 21/1652; B05C 17/0052; B05C 17/00503; B05C 17/00596; B05C 17/10
(Continued)

(56) References Cited

U.S. PATENT DOCUMENTS 5,471,704 A * 12/1995 Woolley ..... E04F 21/165 15/105.5
5,675,860 A * 10/1997 Campbell ..... E04F 21/165 15/235.7
(Continued)

FOREIGN PATENT DOCUMENTS

| | | | |
|---|---|---|---|
| GB | 2348237 | A | 9/2000 |
| JP | H07275764 | A | 10/1995 |
| WO | 2017051227 | A1 | 3/2017 |

OTHER PUBLICATIONS

International Search Report of International Application No. PCT/IB2018/055932, dated Jan. 24, 2019, 3 pages.
(Continued)

*Primary Examiner* — Jennifer C Chiang
(74) *Attorney, Agent, or Firm* — Maine Cernota & Rardin

(57) ABSTRACT

A construction of a smoothening pad for an applicator where, in order to make the smoothening pad more resistant to wear, a more rigid silicone is used for forming it and a bolster made of a softer polymer is provided in the front portion of the smoothening pad so as to make the front portion and the face of the smoothening pad more elastic, wherein the bolster is covered with a layer of a polymer that is more rigid than the material used for forming the body, or alternatively, a gap or chambers are formed in the front portion that in turn may be divided into sub-chambers by partitions. This way, the smoothening pad is provided with a face, that has the required degree of elasticity but is more resistant to wear.

8 Claims, 14 Drawing Sheets

(51) Int. Cl.
*B05C 17/005* (2006.01)
*B05C 17/10* (2006.01)

(58) Field of Classification Search
USPC ..... 401/266
See application file for complete search history.

(56) References Cited

U.S. PATENT DOCUMENTS

| | | | | |
|---|---|---|---|---|
| 7,972,074 | B2 * | 7/2011 | Lepage | E04F 21/1655 401/266 |
| 8,845,223 | B2 * | 9/2014 | Liao | B05C 17/00516 401/266 |
| 10,294,678 | B2 * | 5/2019 | Kensap | B05C 17/00503 |

OTHER PUBLICATIONS

Written Opinion of The International Searching Authority of International Application No. PCT/IB2018/055932, dated Jan. 24, 2019, 9 pages.
International Preliminary Report of Patentability of International Application No. PCT/IB2018/055932, dated Jan. 21, 2020, 10 pages.

* cited by examiner

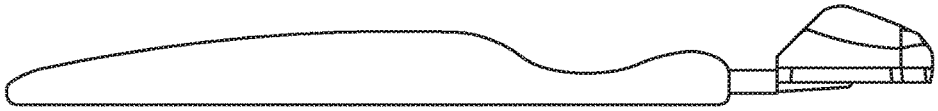
FIG 6B
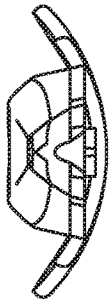
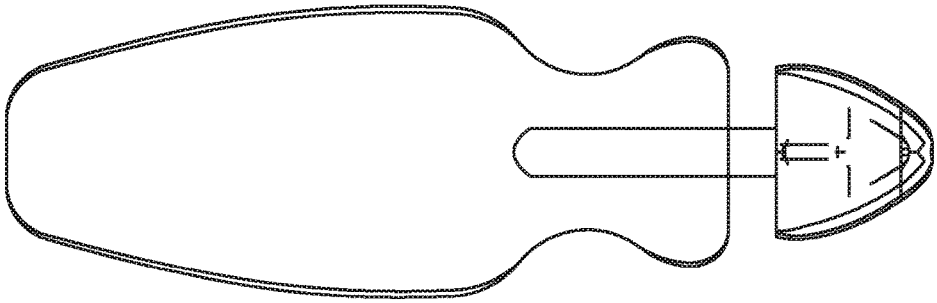
FIG 6C
FIG 6A
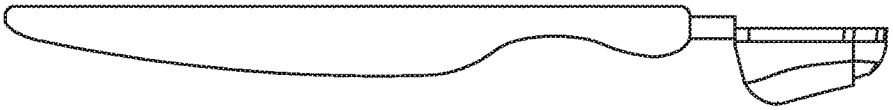
FIG 7B
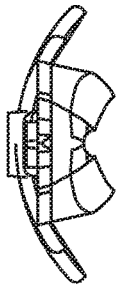
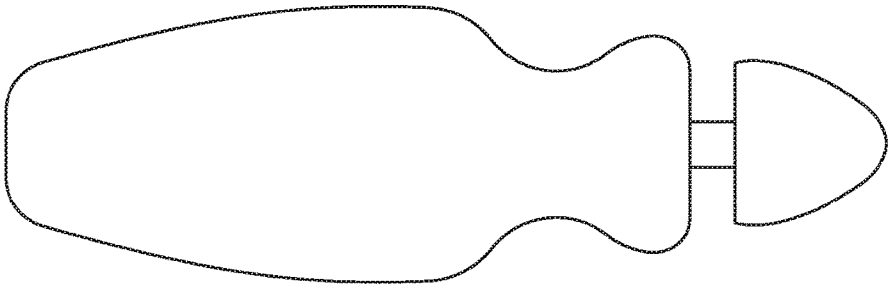
FIG 7A
FIG 7C

G - G
16
11
8

14
10
11
15

G
G
14

15
H
H

H - H

P - P

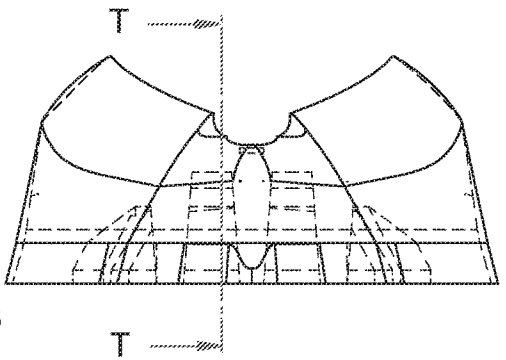
FIG 16B
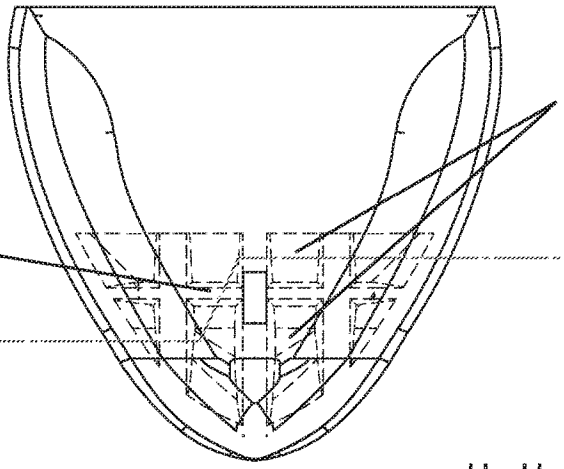
FIG 16A
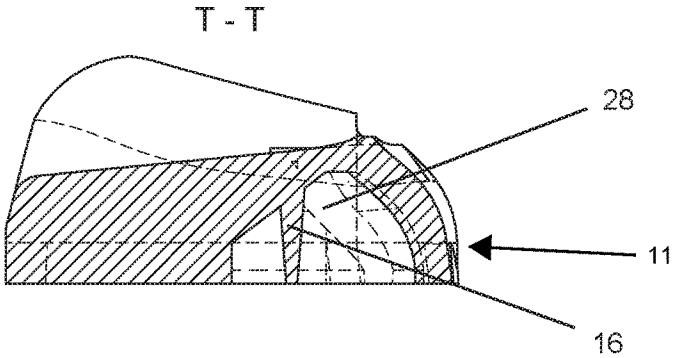
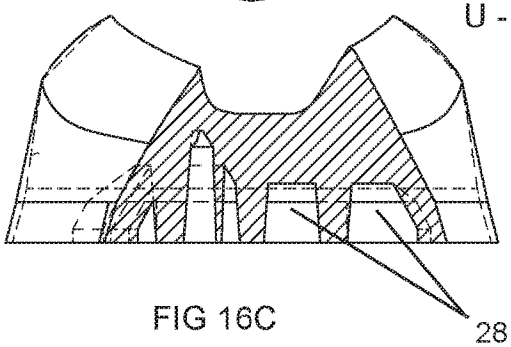
FIG 16C
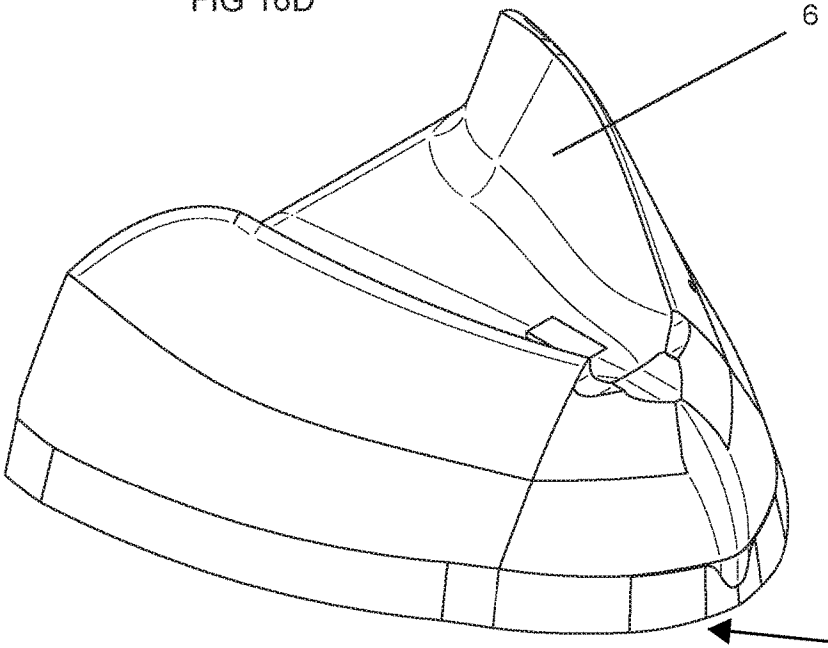
FIG 16D
FIG 16E

SMOOTHENING PAD FOR AN APPLICATOR FOR SEALANTS

RELATED APPLICATIONS

This application is a national phase application filed under 35 USC §371 of PCT Application No. PCT/IB2018/055932 with an International filing date of Aug. 7, 2018, which claims priority of EE Patent Application P201700027 filed Jul. 20, 2017. Each of these applications is herein incorporated by reference in its entirety for all purposes.

FIELD OF THE INVENTION

This invention relates to aids used in the construction industry for smoothing joints, more specifically the invention relates to a smoothening pad for an applicator for sealants which can be used for finishing and for compressing sealing materials applied to the joints and gaps between various surfaces.

PRIOR ART

The author of the invention has already been granted protection for an applicator intended for applying and smoothing sealants and including a smoothening pad as the working portion. Document WO2017/051227, 30 Mar. 2017 (OKEI MEISTRID OÜ), describes an applicator (see FIG. 17) comprising an attachment portion or base attached to a sealing material tube, which is made up of a conical collar attached to the nuzzle of the tube of a viscous material and a support for a smoothening pad. The support is a channel into which a rotatable and or raised portion is attached by an axle. The raised portion includes a linearly moveable footing to which the smoothening pad is attached. The support stays in such an angle relative to the base that ensures a customary angle between the tube of viscous material and the surface being sealed. The shape of the smoothening pad is designed so that it imitates a human finger pressed into the corner, wherein the smoothening pad is a pad made of some elastic material (e.g., silicone) that expands backward and is provided with wings that copy the surface of a wall. The pad has an elevated portion in its central part, which allows directing the excess viscous material accumulated on the pad back to the surface being sealed or smoothed or to the corner between the surfaces. In alternative solutions, the shape of the pad is altered according to the required grade of smoothness or the material used for sealing corners/surfaces.

The experiments and working with the applicator have shown that a pad made of silicone may wear faster than expected. Also, if the user applies too much pressure on the pad, the wings located at the sides of the pad may twist forward (i.e., toward the smoothed surface of the joint, in the direction opposite to the movement of the applicator) and as a result, the surface of the applied sealing material may become uneven or the excess sealing material that is removed from the joint may move back to the joint. Besides, due to the forward twisting of the wings, the smoothening pad may wear faster than expected.

DISCLOSURE OF THE INVENTION

The object of this invention is to provide a solution for the construction of the smoothening pad for the already patented applicator so as to make the smoothening pad more resistant to wear and to prevent the forward twisting of the smoothening pad wings in cases where the user applies too much pressure on the applicator and consequently, on the smoothening pad.

In addition, the end of the smoothening pad has to be made softer so as to prevent the sealing material from flowing out through the wings. Also, the end of the smoothening pad needs to be softer for the reason that in the cases when the angle of the joint is not 90 degrees (e.g., is only 85 degrees), the softer end of the smoothening pad makes the corner smooth with the first stroke filling the corner better, whereas if the end of the smoothening pad is more rigid, the corner has to be smoothed several times and the applicator needs to be pressed very hard, which means that the user (house painter, for example) needs to spend more time on smoothing the joint and the smoothening pad wears faster.

As a solution, the authors of this technical solution provide a smoothening pad which is made of some elastic polymer (e.g., silicone) that has portions of different hardness or elasticity. The front portion of the smoothening pad (the face), which first comes into contact with the sealing material (wherein the sealing material, as used herein, means silicone (e.g., silicone that solidifies in the air), sealant or some other viscous material (e.g., rubber or various glues used for sealing joints, etc.) that is used in the corners of walls or ceilings and the gaps between surfaces (joints) as an elastic material ensuring the required degree of sealing, the impermeability and appearance of joints), is formed from a softer and more flexible polymer (or with cavities) and the rear portion of the smoothening pad and the wings are made from a harder and more rigid material. This solution ensures that the more flexible front portion or the face of the smoothening pad that smoothes the sealing material in the joint moves more easily along the sealing material, providing an even and smooth surface. At the same time, the more rigid rear portion of the smoothening pad prevents the wings (also made from a more rigid elastic polymer, e.g., silicone) from bending forward, i.e., in the direction opposite to the movement direction of the smoothening pad. In an alternative embodiment, the softer and more flexible front portion of the smoothening pad is covered with a layer of a more rigid elastic polymer (e.g., silicone) so as to make the pad even more resistant to wear, whereas the more rigid upper polymer layer adds elasticity to the front portion of the smoothening pad so as to ensure the required smoothness of the surface of the sealing material. By covering the softer portion of the smoothening pad with a layer of a more rigid polymer, the fast wear of the face of the smoothening pad and stretching of the smoothening pad is prevented.

In addition, the authors of this invention provide a smoothening pad which is made entirely from a more rigid silicone, but during the production process a gap or channels are formed at the end of the smoothening pad that make the end of the smoothening pad more flexible, i.e., which ensure the required flexibility of the polymer (e.g., silicone) used for producing the smoothening pad, or more specifically, the required elasticity of the face of the smoothening pad.

The shape of the smoothening pad is designed so that it imitates a human finger pressed into the corner, wherein the smoothening pad is a pad made of an elastic material (e.g., silicone) that expands backward and has wings that copy the surface of the wall. In the central portion of the pad, there is an elevation, allowing the excess viscous material to be guided back to the surface being sealed or smoothed or the corner between surfaces. In alternative solutions, the shape of the smoothening pad is altered according to the required grade of smoothness or the material used for sealing corners/surfaces.

LIST OF FIGURES

The invention is now described in more detail in exemplary embodiments with reference to the drawings, in which FIG. 1 shows a smoothening pad for an applicator according to the invention, intended for smoothing planar joints, provided with a footing, and used on an applicator known in the prior art and shown in FIG. 17 that can be attached to a sealing material tube;

FIGS. 6A-6C show the top, side and front view of the smoothening pad with a footing and a handle shown in FIG. 2, used on a manual applicator;

FIGS. 7A-7C show the top, side and front view of the smoothening pad for an applicator with a footing and a handle shown in FIG. 4;

FIGS. 16A-16E show the top and front view of the second embodiment of the smoothening pad used for smoothing corner joints, a section along the line U-U in FIG. 16A, a cross section along the line T-T in FIG. 16B and a perspective view of the second embodiment of the smoothening pad according to the invention for smoothing corner joints;

EMBODIMENTS

Figure 2:
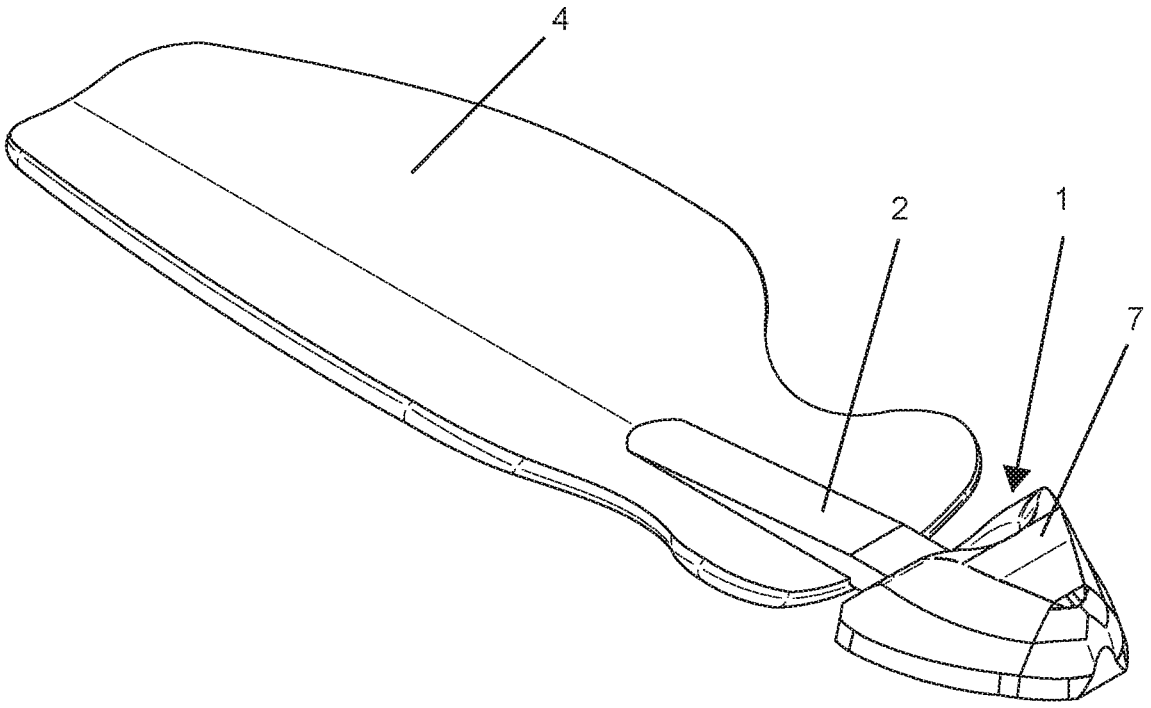
FIG. 2 shows a smoothening pad for an applicator according to the invention, intended for smoothing planar joints, provided with a footing and a handle, and used on the manual applicator used for smoothing joints.
Figure 17:
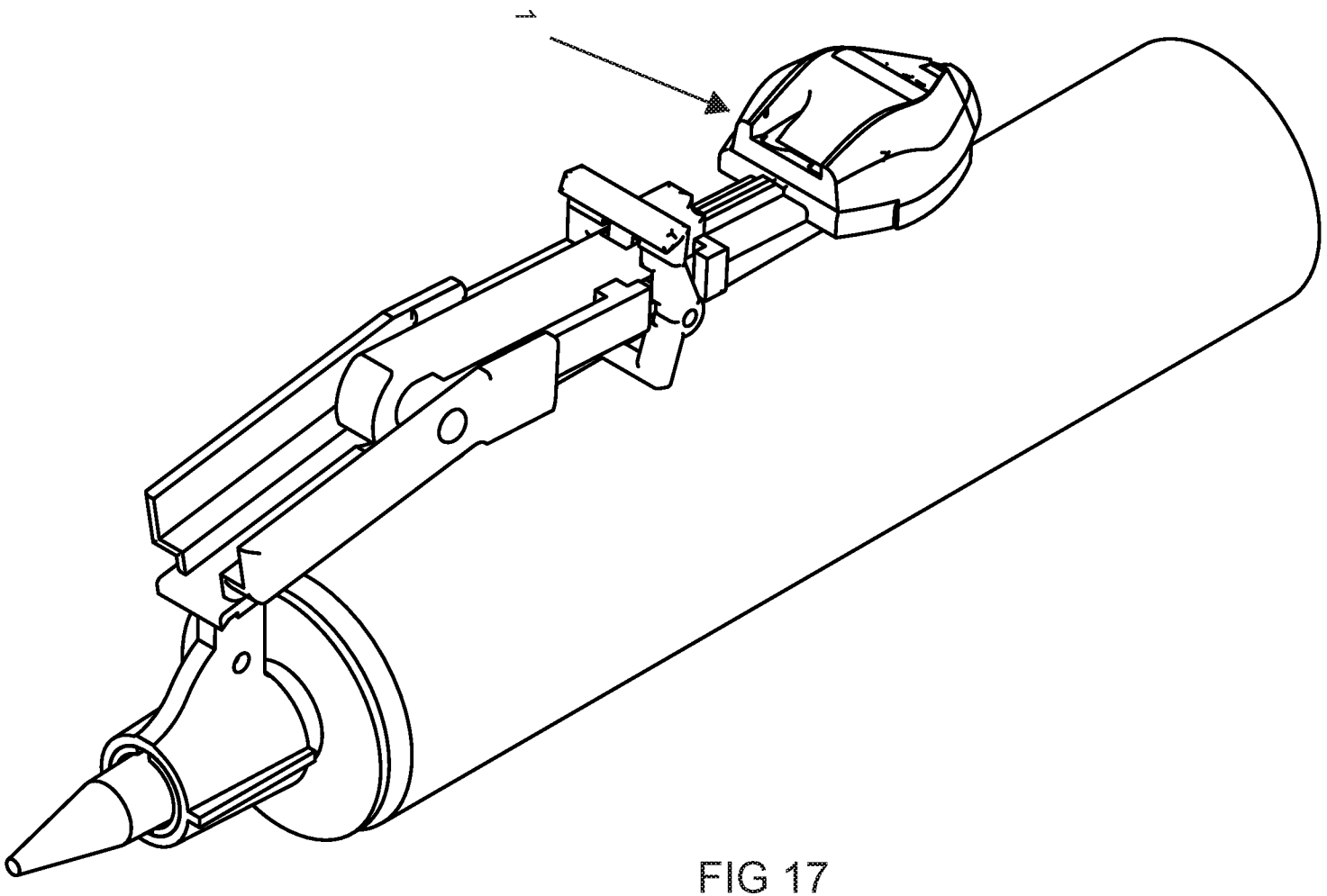
FIG. 17 shows an applicator for sealants known in the prior art, which is provided with a smoothening pad and a footing and is attached to the sealing material tube.

The smoothening pad 1 may be used on the applicator that is attached to a sealing material tube (see FIG. 17). It may also be used on the manual applicator intended for smoothing joints filled with sealing material by hand (see FIG. 2).

Figure 1:
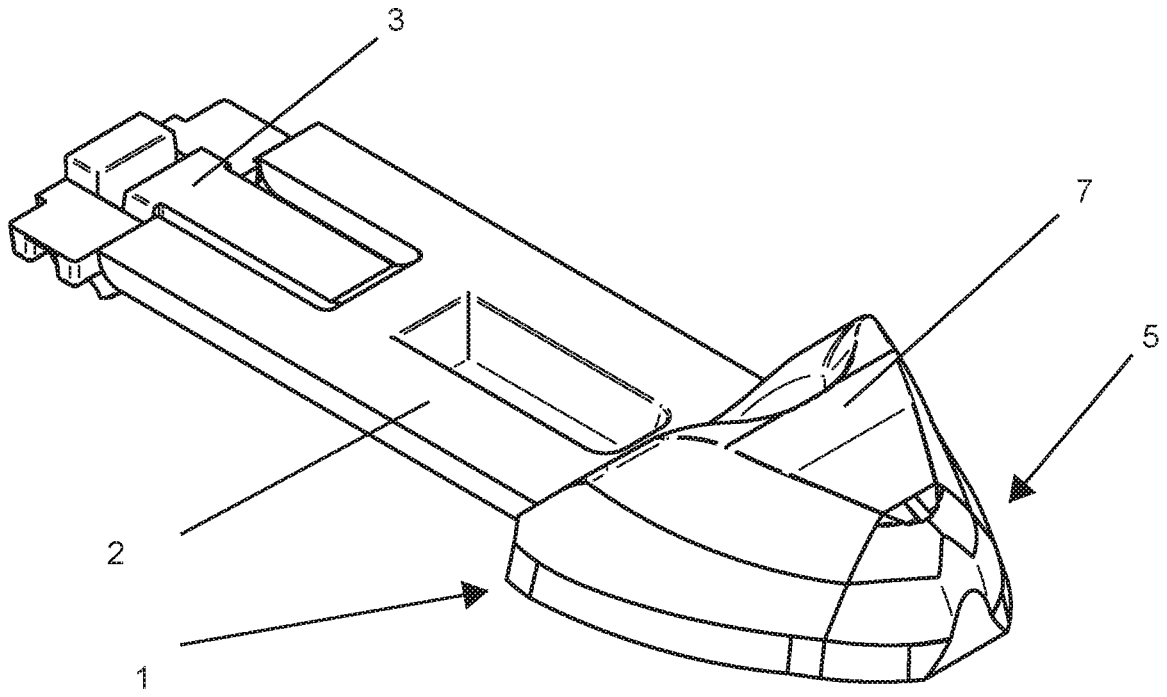
Figure 3:
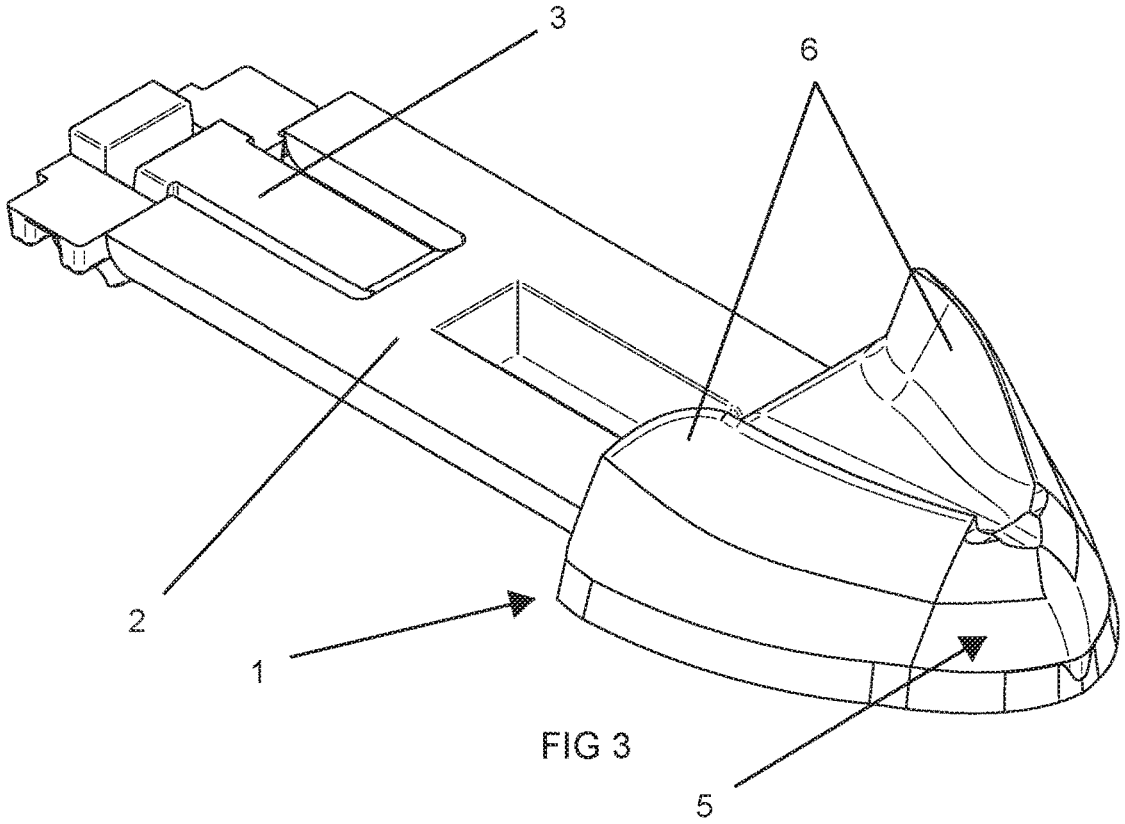
FIG. 3 shows a smoothening pad for an applicator according to the invention, intended for smoothing corner joints, provided with a footing, and used on the applicator known in the prior art and attached to the sealing material tube, as shown in FIG. 17.
Figure 4:
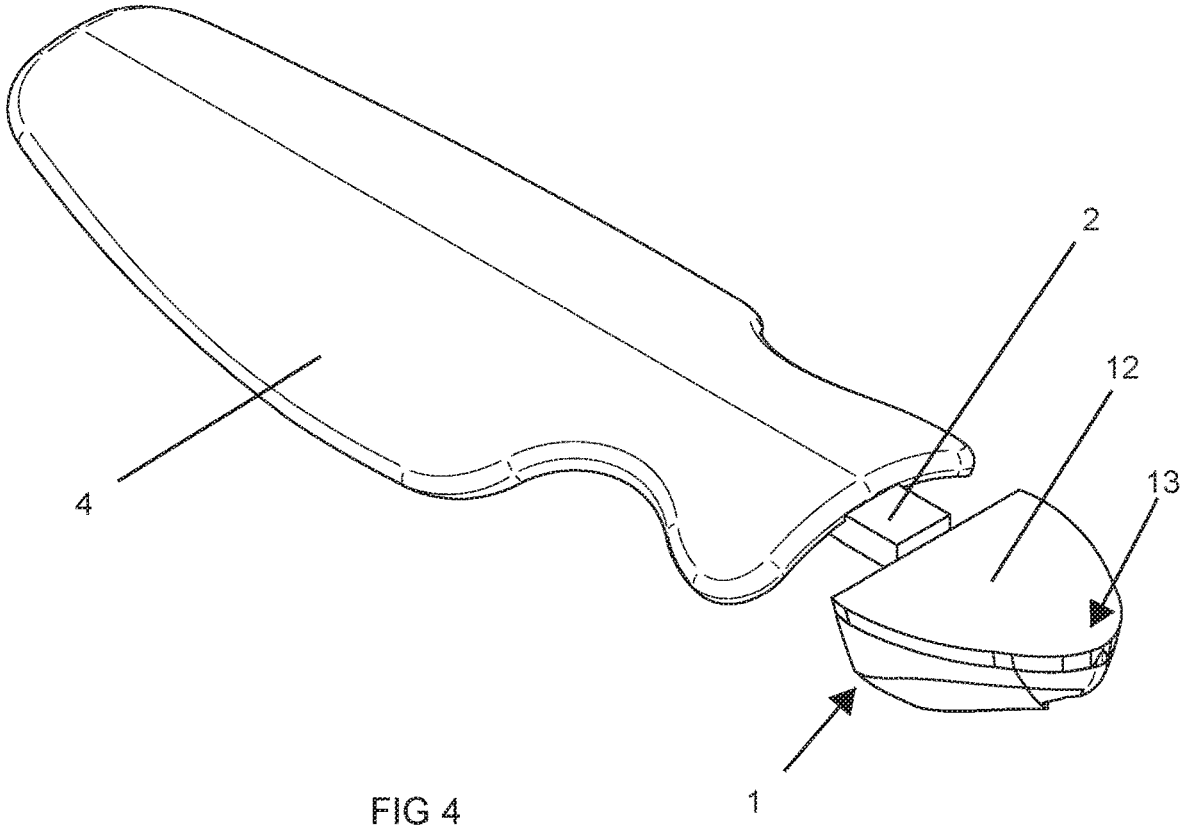
FIG. 4 shows the smoothening pad for an applicator according to the invention, intended for smoothing corner joints, provided with a footing and a handle, and used on a manual applicator for smoothing joints.
Figure 5B:
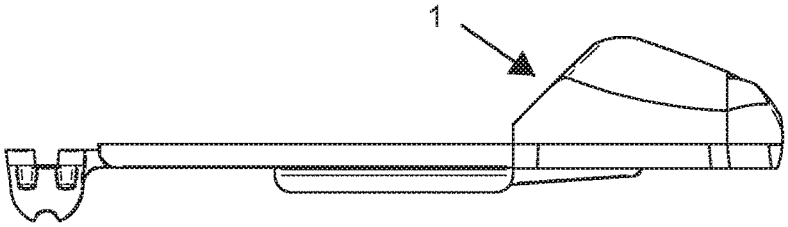
FIGS. 5A-5E show the top, side and front view of the smoothening pad for an applicator shown in FIG. 1 provided with a footing, a cross section along the line A-A in FIG. 5A and the fragmentary sectional view B of the front part of the smoothening pad shown in FIG. 5C.
Figure 5D:
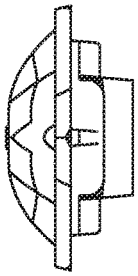
Figure 5A:
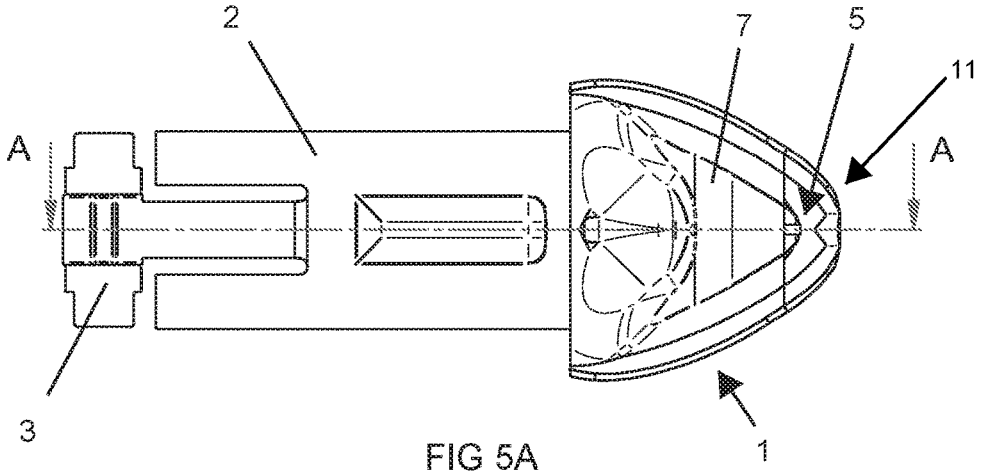
Figure 5C:
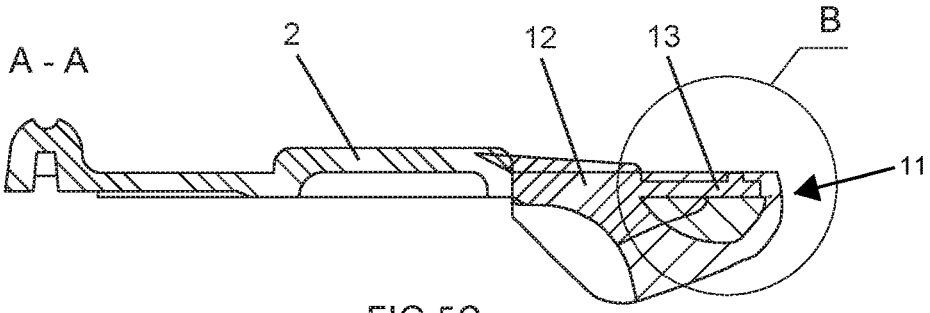
Figure 5E:
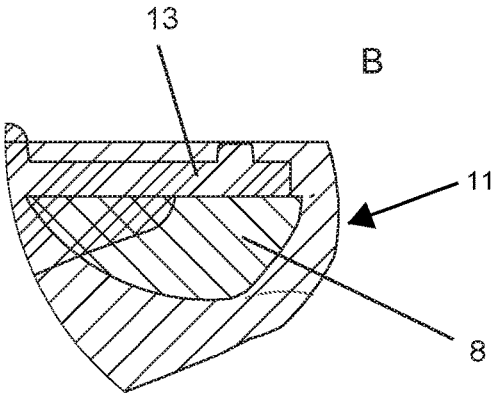
Figure 8D:
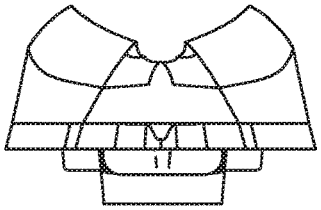
FIGS. 8A-8E show the top, side and front view of the smoothening pad for an applicator with a footing shown in FIG. 3, a cross section along the line C-C in FIG. 8A and the fragmentary sectional view D of the front part of the smoothening pad.
Figure 8C:
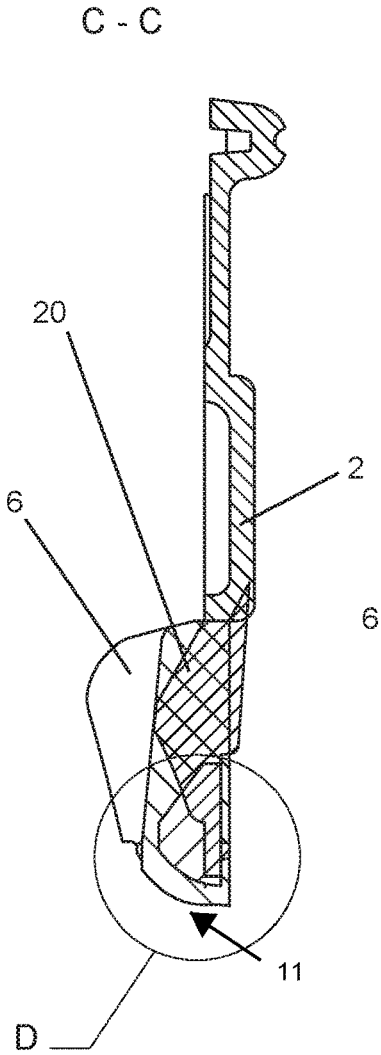
Figure 8A:
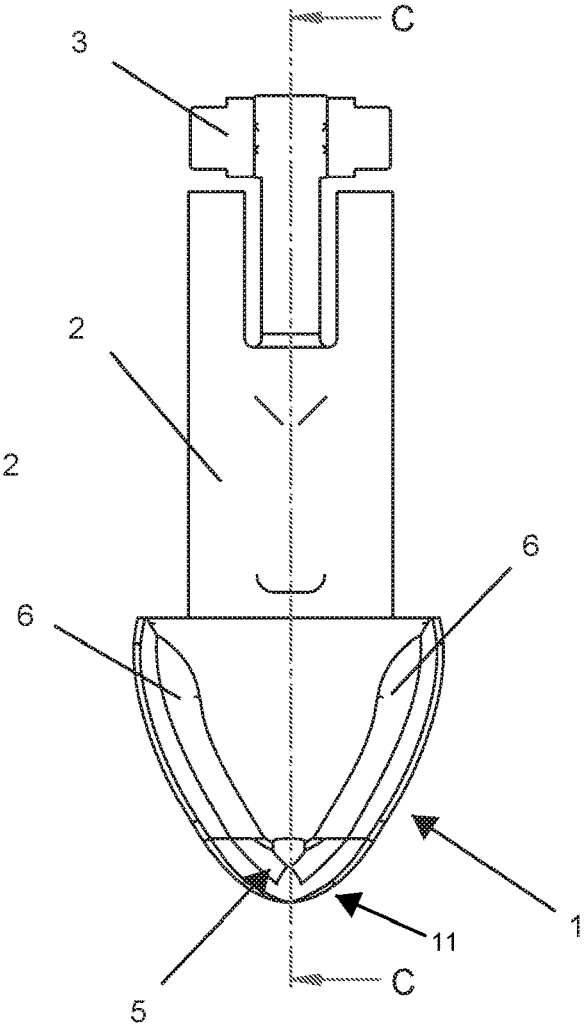
Figure 8B:
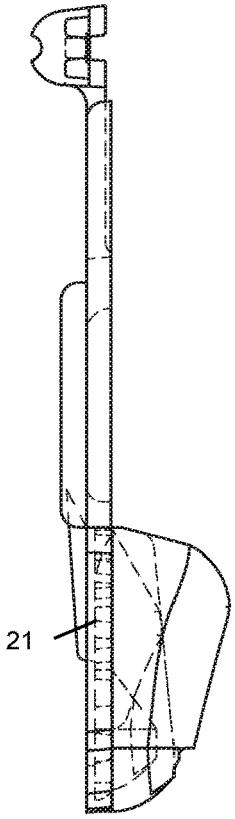
Figure 8E:
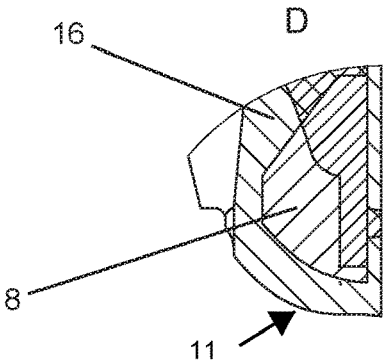
Figure 9B:
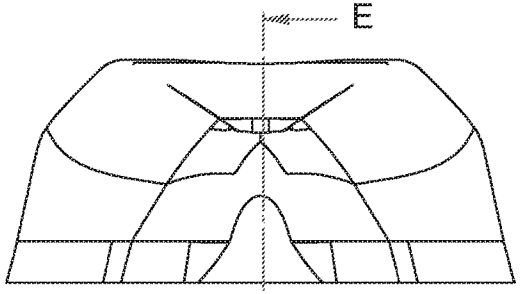
FIGS. 9A-9E show the top and front view of the smoothening pad used for smoothing joints between planar surfaces, a section along the line F-F shown in FIG. 9A, a cross section along the line E-E in FIG. 9B and the perspective view of the smoothening pad according to the invention.
Figure 9A:
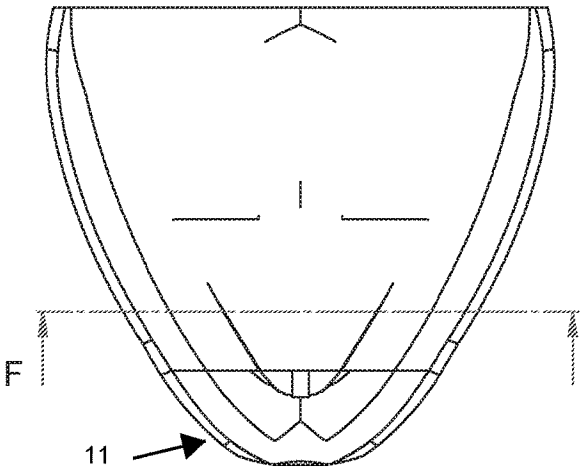
Figure 9C:
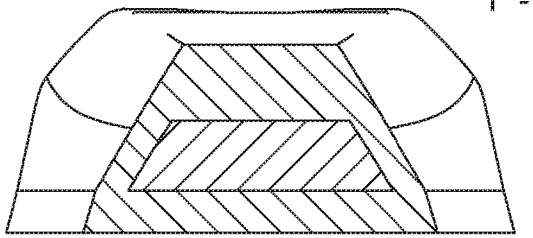
Figure 9D:
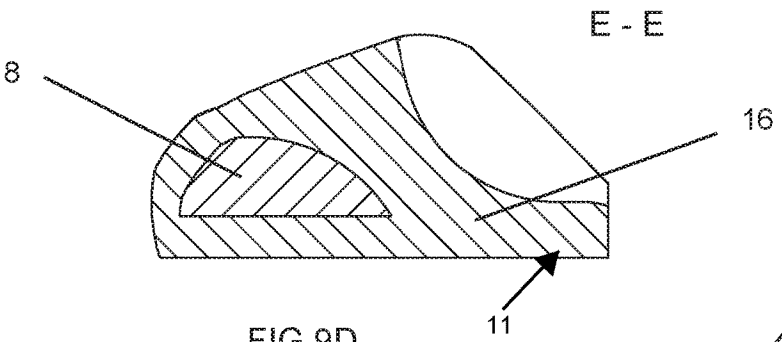
Figure 9E:
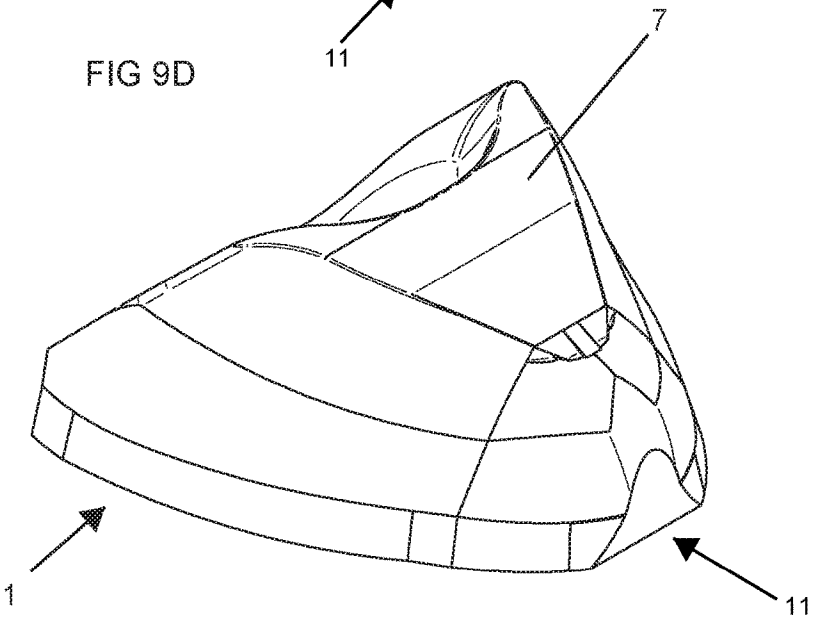
Figures 10A, 10B, 10C, 10D, 10E:
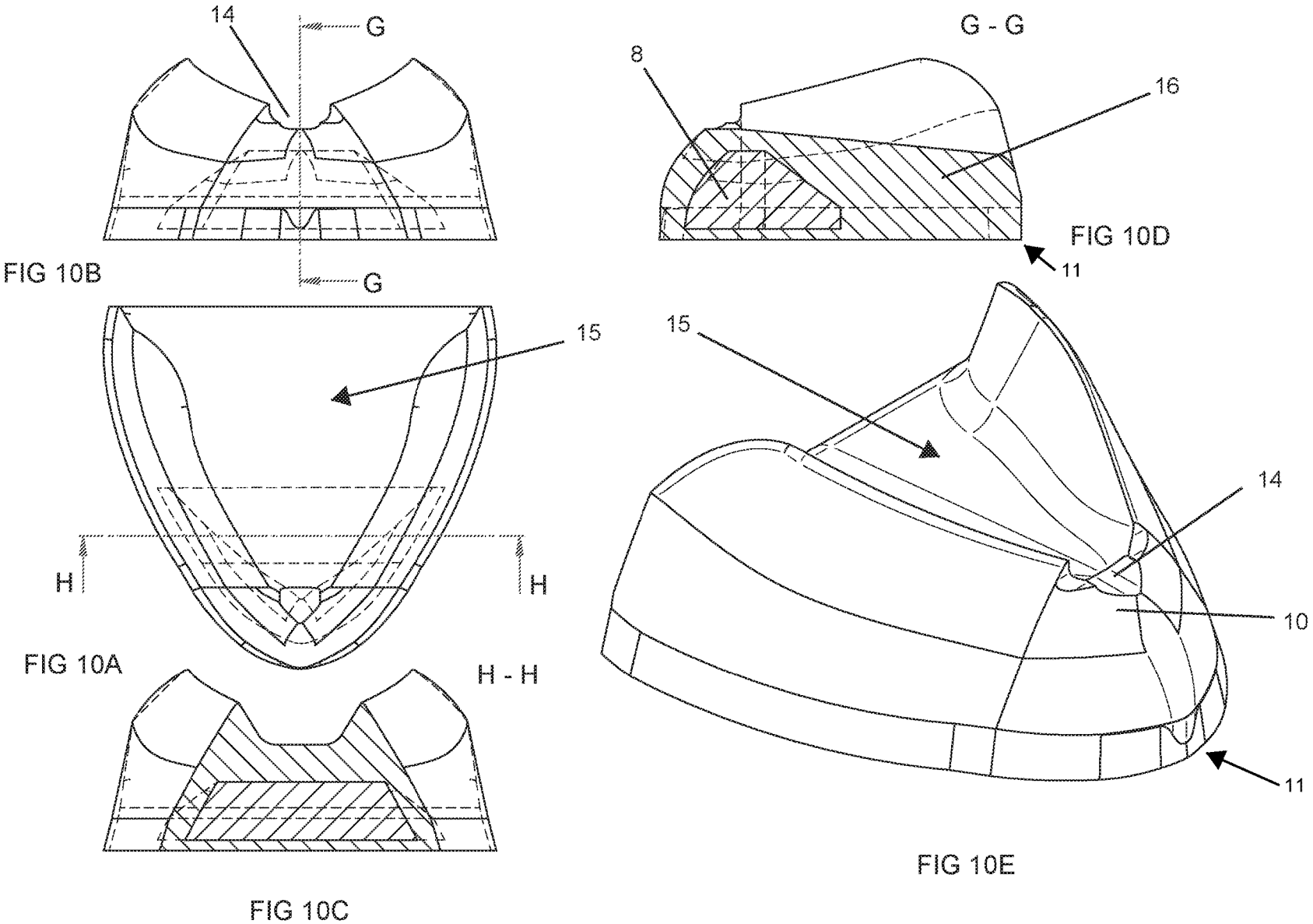
FIGS. 10A-10E show the top and front view of the first embodiment of the smoothening pad used for smoothing corner joints, a section along the line H-H on FIG. 10A, a cross section along the line G-G in FIG. 10B and a perspective view of the smoothening pad according to the invention for smoothing corner joints.
Figure 11D:
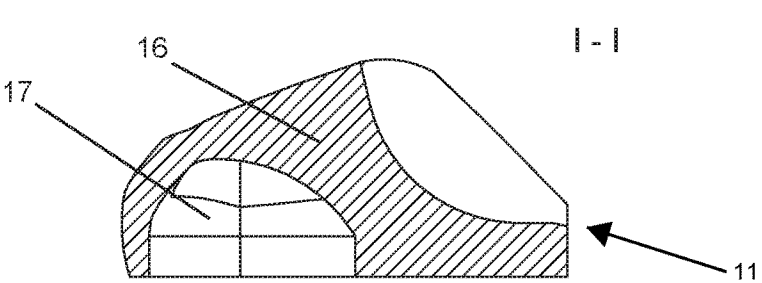
FIGS. 11A-11E show the top and front view of the second embodiment of the smoothening pad for smoothing planar joints, a section along the line J-J in FIG. 11A, a cross section along the line I-I in FIG. 11B and a perspective view of the second embodiment of the smoothening pad according to the invention for smoothing planar joints.
Figure 11E:
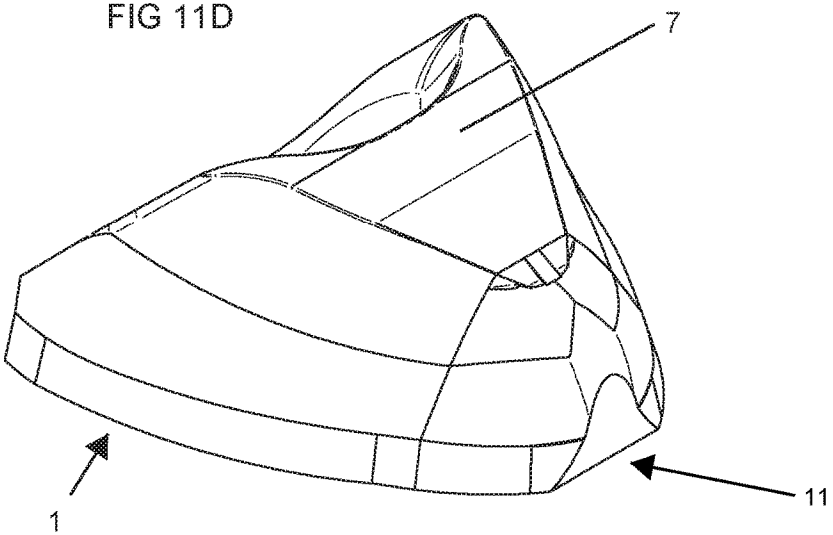
Figure 11B:
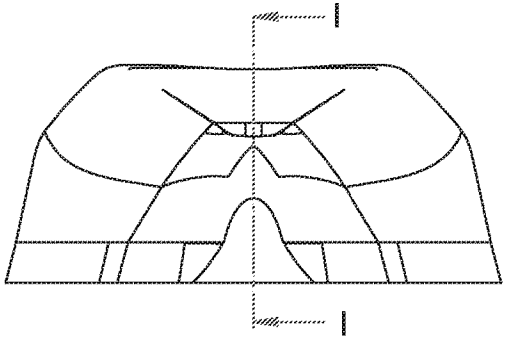
Figure 11A:
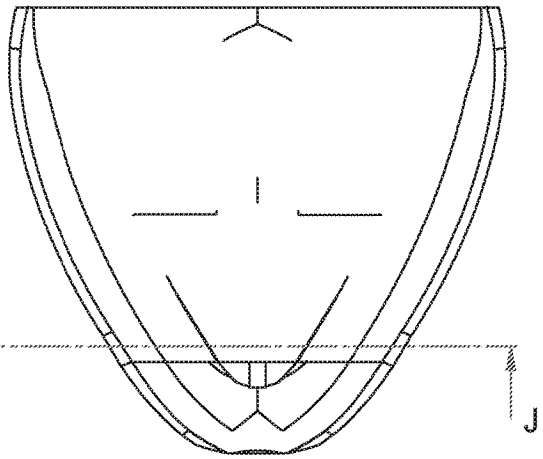
Figure 11C:
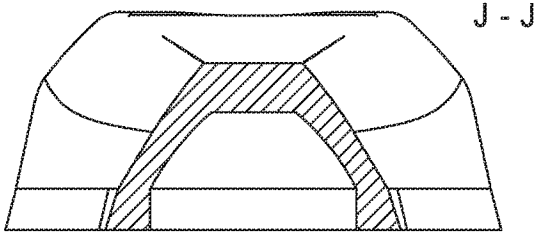
Figures 12A, 12B, 12C, 12D, 12E:
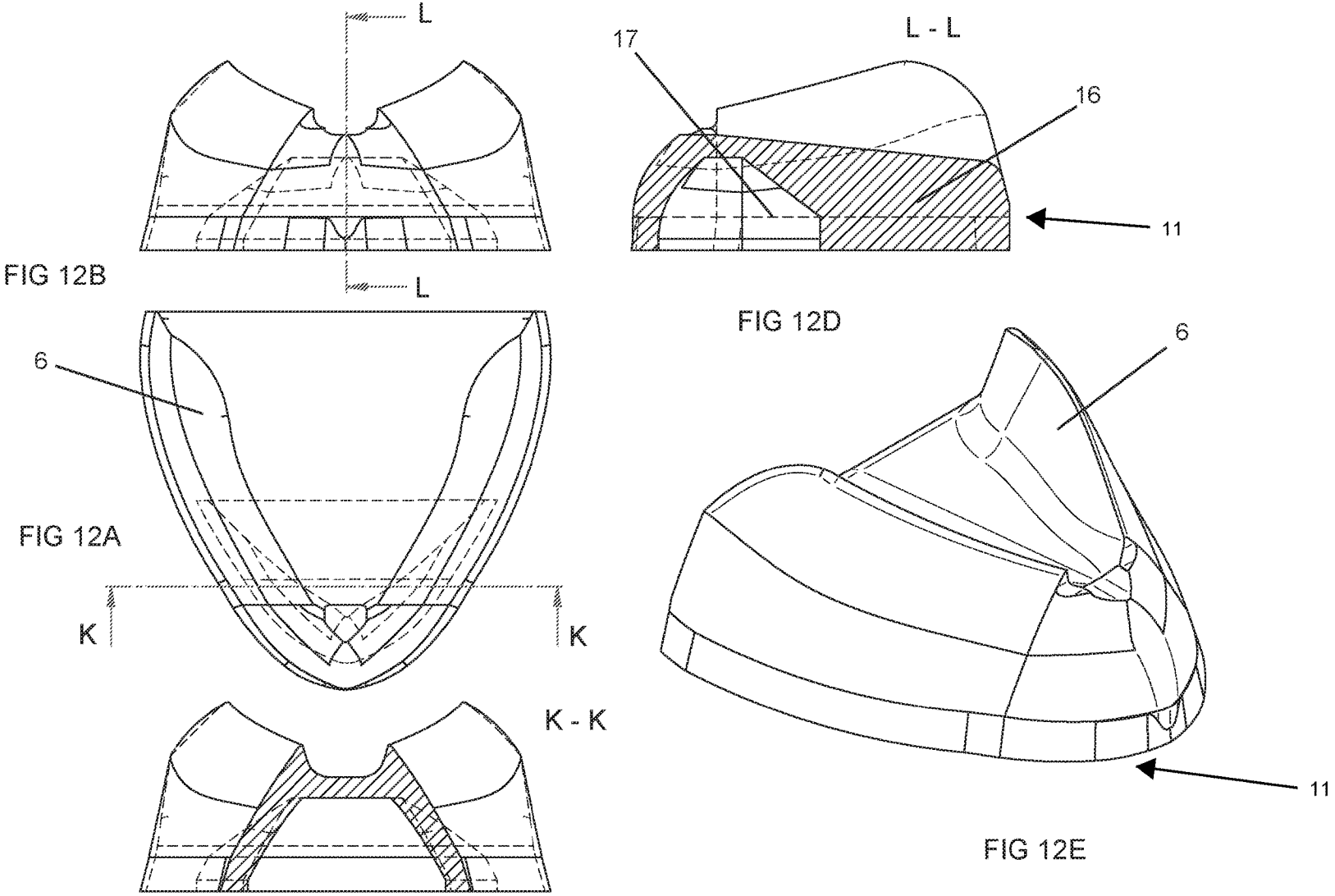
FIGS. 12A-12E show the top and front view of the second embodiment of the smoothening pad used for smoothing corner joints, a section along the line K-K in FIG. 12A, a cross section along the line L-L in FIG. 12B and a perspective view of the second embodiment of the smoothening pad according to the invention for smoothing corner joints.
Figure 13D:
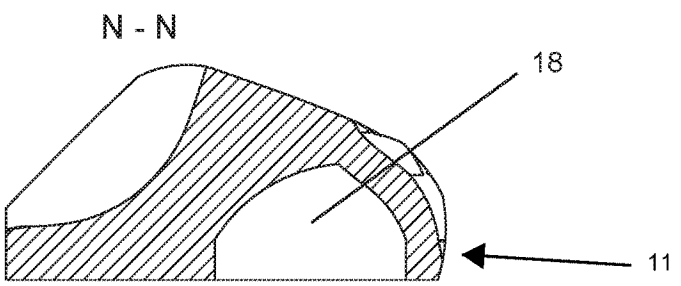
FIGS. 13A-13E show the top and front view of the second embodiment of the smoothening pad for smoothing planar joints, a section along the line M-M in FIG. 13A, a cross section along the line N-N in FIG. 13B and a perspective view of the third embodiment of the smoothening pad for smoothing planar joints.
Figure 13E:
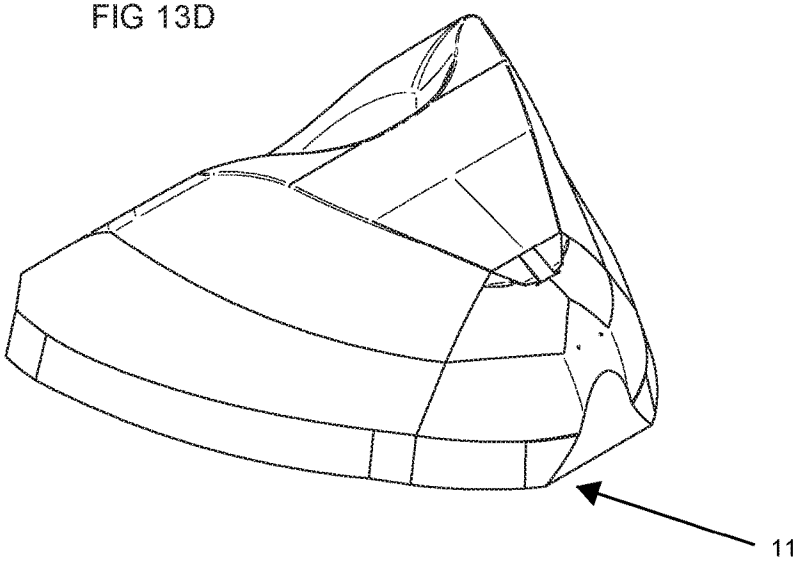
Figure 13B:
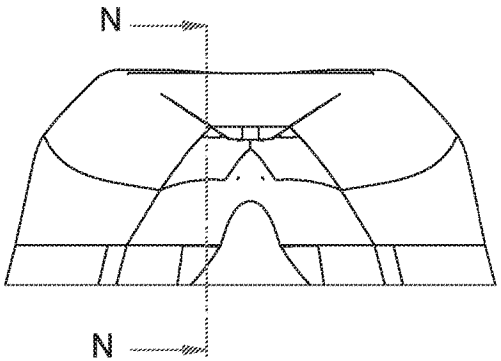
Figure 13A:
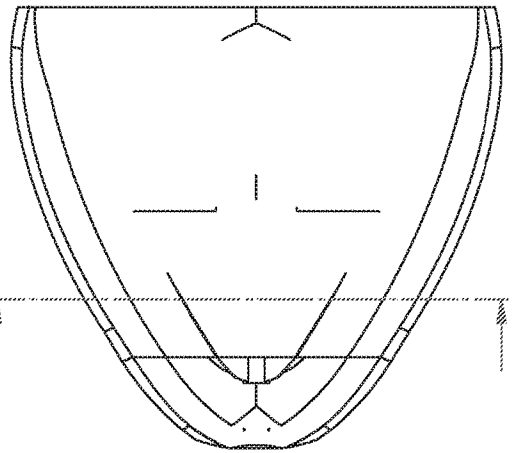
Figure 13C:
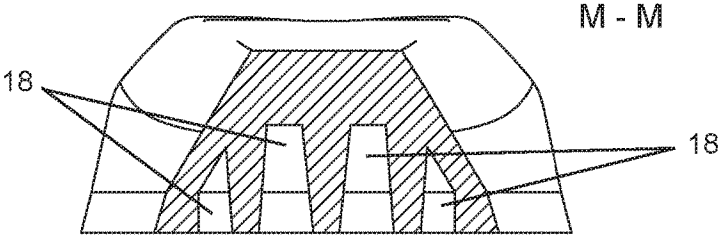
Figure 14D:
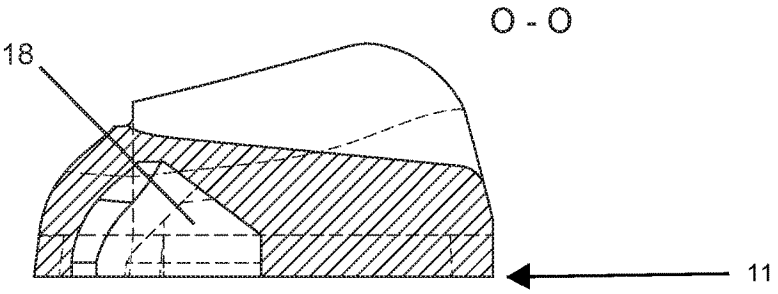
FIGS. 14A-14E show the top and front view of the second embodiment of the smoothening pad for smoothing corner joints, a section along the line P-P in FIG. 14A, a cross section along the line O-O in FIG. 14B and a perspective view of the second embodiment of the smoothening pad according to the invention for smoothing corner joints.
Figure 14E:
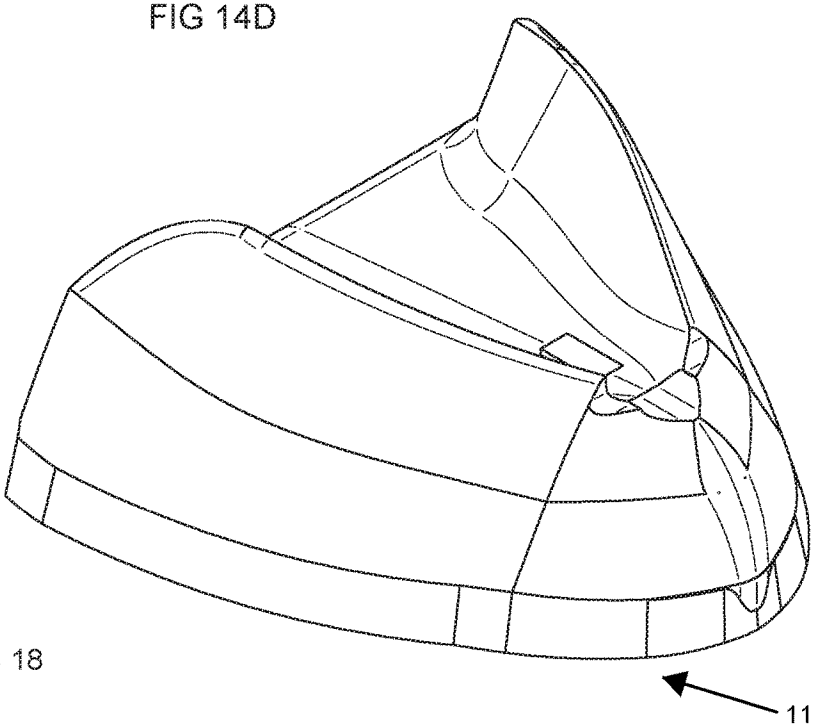
Figure 14B:
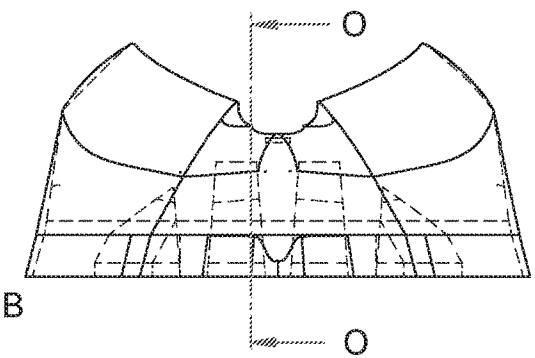
Figure 14A:
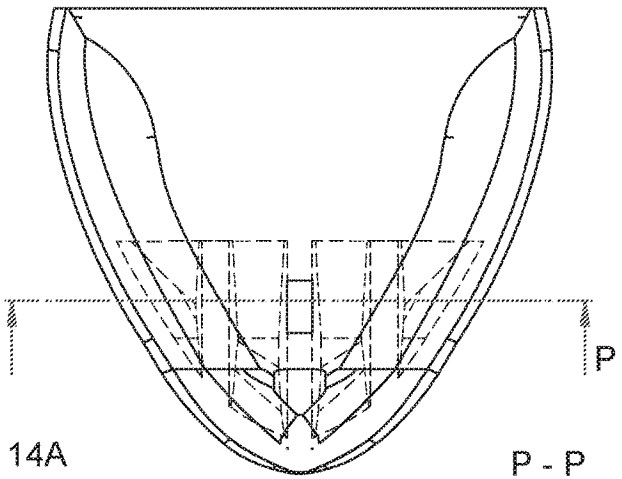
Figure 14C:
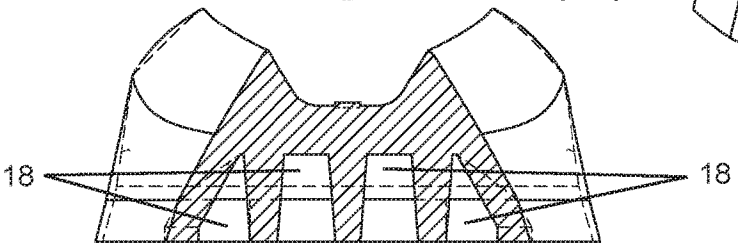
Figure 15D:
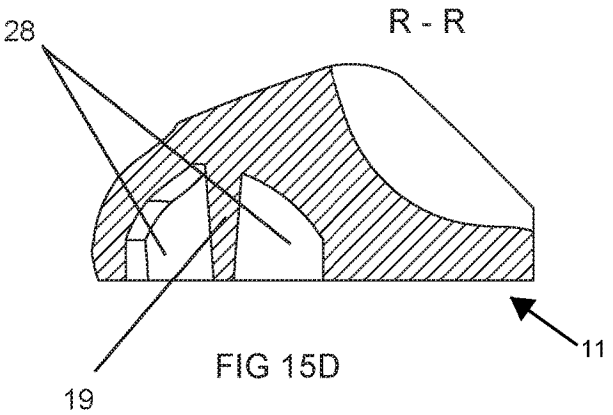
FIGS. 15A-15E show the top and front view of the second embodiment of the smoothening pad for smoothing planar joints, a section along the line S-S in FIG. 15A, a cross section along the line R-R in FIG. 15B and a perspective view of the fourth embodiment of the smoothening pad according to the invention for smoothing planar joints.
Figure 15E:
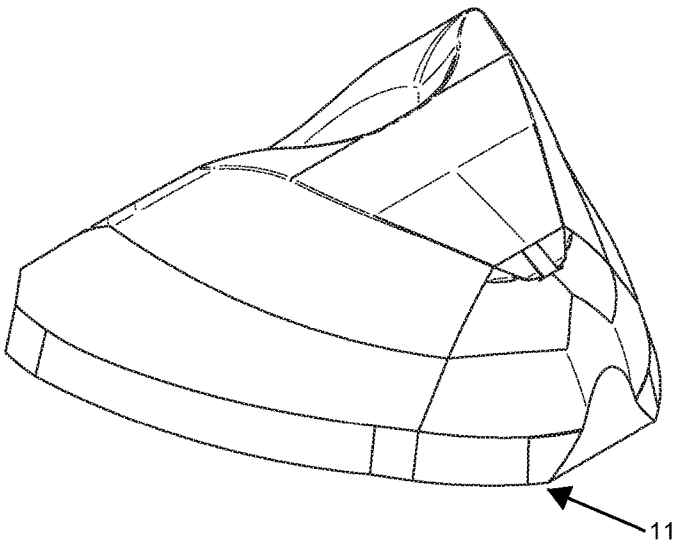
Figure 15B:
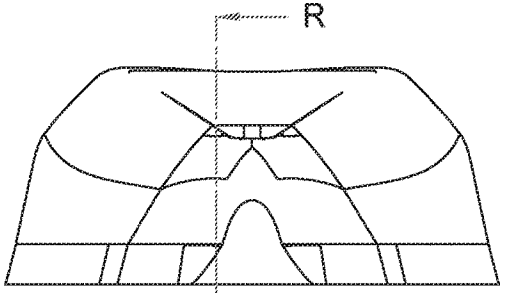
Figure 15A:
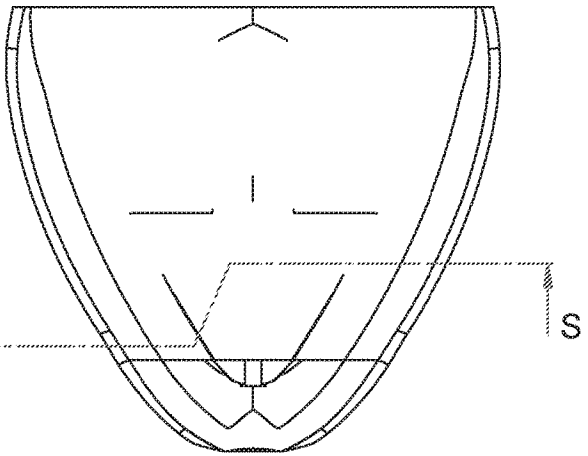
Figure 15C:
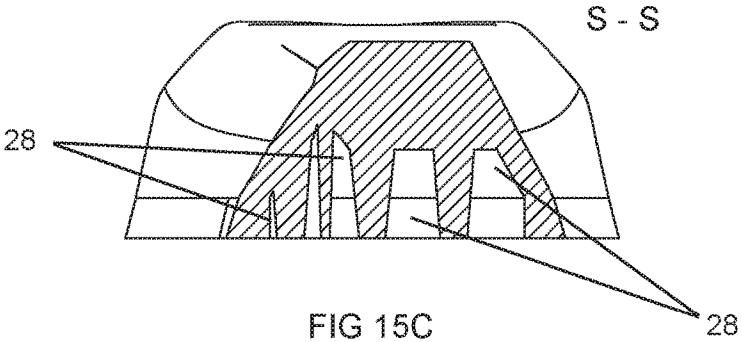

The smoothening pad 1 for the applicator is attached to a footing 2 or moulded by mould casting around the footing so that the triangular head 12 of the footing 2 remains inside the smoothening pad 1 (see FIGS. 5A, 5C and FIGS. 8A, 8C). The footing 2 of the smoothening pad is integrated with fastening elements 3 for attaching the footing 2 of the smoothening pad and the smoothening pad 1 to the applicator (FIG. 17), but the footing 2 may also be integrated to the handle 4 of a manual applicator. The smoothening pad 1 is made of an elastic polymeric material or polymer (e.g., silicone) and it is (usually triangular when seen from the top) designed so that its face 5 in the front portion 11 imitates a human finger and the smoothening pad 1 expands backward if it is intended for smoothing planar joints (see FIGS. 1, 2) or is provided with wings 6 copying the surface of the wall if the pad is intended for smoothing corner joints (see FIGS. 3, 4). The authors of the invention consider the various embodiments of the smoothening pad 1, as described here and below, as two equivalent alternative embodiments, i.e., as a smoothening pad used on an applicator that can be attached to a sealing material tube used for sealing joints (see FIGS. 1, 3, 5A-5E, 8A-8E) or a smoothening pad used on a manual applicator for smoothing joints (see FIGS. 2, 4, 6A-6C, 7A-7C).

The smoothening pad 1 used for smoothing planar joints has an elevation 7 in its central portion (see FIGS. 1, 2, 9E, 11E, 13E, 15E), allowing to direct the excess viscous material accumulated on the pad back to the sealed or smoothed surface or planar joint, which means that the smoothening pad is designed so that it can be used for finishing planar surfaces, e.g., for smoothing viscous materials pressed into the joint between two panels.

The smoothening pad 1 shown in FIGS. 1, 2, 9E, 11E, 13E and 15E is intended for general finishing of edgings (planar joints, i.e., joints between two adjacent gypsum baseboards, for example) with, e.g., acrylic material, silicone, polyurethane-based sealant, putty, bitumen-based paste, etc.

The smoothening pad shown in FIGS. 3, 4, 10E, 12E, 14E, 16E is intended for general finishing of corner joints with different materials, such as acrylic material, silicone, polyurethane-based sealant, putty, bitumen-based paste, etc.

The face 5 of the smoothening pad 1 used for smoothing corner joints also imitates a human finger pressed into the corner (generally, users smooth the silicone used for sealing the corner joints between details with their finger because this is the easiest way for levelling the surface of the sealing material and then removing the excess sealing material). Using the finger for smoothing joints, however, harms the skin on the finger so that after finishing the process the user's finger(s) might be injured and sore.

The smoothening pad 1 for smoothing corner joints has a cavity 14 in the front portion, allowing the front portion 11 and the face 5 of the smoothening pad 1 to move as deep within the corner as possible (the face 5 of the smoothening pad is pressed into the joint as precisely as possible) and push the excess sealing material into the space 15 between the wings of the smoothening pad. On the sides of the smoothening pad 1, wings 6 directed upward have been provided that copy the surfaces of the wall against which the wings 6 of the smoothening pad 1 are pressed when finishing corners with some viscous sealing material. In the central portion of the smoothening pad 1, a small elevation 10 is provided, allowing to guide part of the excess viscous material that accumulates on the front portion 11 of the smoothening pad 1 back to the finished corner, whereas a small cavity 14 provided in the front portion 11 allows the rest of the excess material to move between the wings 6 of the smoothening pad so that the precise amount of material needed for sealing and smoothing the joint remains within it.

The smoothening pad 1 according to the first embodiment has a bolster or pad 8 at the end 13 of the triangular head 12 of the footing 2 in the front portion 11 of the smoothening pad 1 according to the invention that is made from a more elastic polymer (e.g., silicone) (see FIGS. 5C, 5E, 8C, 8E, 9*c*, 9D, 10C, 10D), which is then, in the process of producing the rest of the body 16 and wings 6 of the smoothening pad 1, covered with a layer of a more rigid polymer.

In the second embodiment, the whole smoothening pad 1 (body 16 of smoothening pad, wings 6) is made from a polymeric material of the same rigidity/elasticity but there is a gap 17 formed in the front portion 11 of the smoothening pad 1 during the moulding process (see FIGS. 11C, 11D, 12C, 12D). As a result, the front portion 11 of the smoothening pad 1 becomes more flexible/softer, i.e., the rigidity of the front portion is decreased so that the face 5 fits better within the corner being sealed or smoothed when the user applies pressure on the smoothening pad during the process.

In the third embodiment, the smoothening pad as a whole (the body 16 and wings 6) is made of a polymeric material of the same rigidity/elasticity but in the front portion 11 of the smoothening pad 1, empty chambers or channels with no outlet 18 are formed during the moulding process (see FIGS. 13C, 13D, 14C, 14D). The shape of the cross section of a channel remains the same along the entire channel.

In the fourth embodiment, the smoothening pad as a whole (the body 16 and wings 6) is made of a polymeric material of the same rigidity/elasticity and in the front portion 11 of the smoothening pad 1, empty chambers or channels with no outlet 18 are formed during the moulding process as in the third embodiment, but the chambers or channels with no outlet 18 are provided with partitions 19 that divide a channel into at least two sub-chambers 28 (see FIGS. 15C, 15D, 16C, 16D). By using partitions 19, the elasticity or flexibility of the front portion 11 and also the face 5 of the smoothening pad can be altered, which in turn makes it possible to use a more elastic silicone for producing the smoothening pad compared to the material used for forming a smoothening pad according to the third embodiment.

So as to fasten or fix the smoothening pad more firmly to the footing 2 and this way prevent the movement of the smoothening pad along the footing or the unfastening of the smoothening pad from the footing, and to ensure necessary sideward rigidity of the smoothening pad 1, a protrusion 20 is formed on the head of the footing 2 that extends vertically to the extent of the front portion of the smoothening pad. The footing with the shape of a triangular head is provided with openings 21 in order to integrate the smoothening pad with the footing during the moulding/forming of the smoothening pad. This way, the footing is firmly fixed inside the smoothening pad.

The footing of the smoothening pad used on a manual applicator is made as one component that also includes a handle, i.e., the footing and the handle are integrated or one of them turns into the other. For the ease of use, the handle 4 has a hollow or curved shape (the edges of the handle curve upward on the side of the face of the smoothening pad).

The smoothening pad for an applicator for joints may be made, for example, by moulding of the polymer in a mould into which either a footing with fasteners or a footing integrated with a handle has already been placed. During the moulding process, the used polymer fills the mould with a shape of the smoothening pad and the opening provided in the head of the footing, thus ensuring that the footing of the smoothening pad remains inside the smoothening pad. In the process of moulding the smoothening pad according to the first embodiment, a polymer bolster is formed onto the end of the head of the smoothening pad footing.

1—smoothening pad
2—footing of the smoothening pad
12—triangular head of the footing
13—end of the head of the footing
3—fasteners
4—handle
5—face of the smoothening pad
6—wings of the smoothening pad
7—elevation
8—bolster or pad
10—elevation
11—front portion of the smoothening pad
14—cavity
15—space between the wings
16—body of the smoothening pad
17—gap
18—empty chambers or channels with no outlet
28—sub-chambers
19—partition
20—protrusion
21—openings

The invention claimed is:

1. A smoothening device for an applicator, the smoothening device comprising a footing and a smoothening pad, wherein a footing comprises a triangular head having openings for integrating the smoothening pad with the footing, and the smoothening pad comprising a front portion having a face, a body made of an elastic material, the smoothening pad being provided on the triangular head of the footing, wherein said body comprises wings formed along the sides of the body with a space between the wings for accumulating excess sealing material, characterised in that a bolster is provided in the front portion of the smoothening pad that is made of a more elastic and softer material than the material used for forming the body of the smoothening pad, or a gap or empty chambers are formed in the front portion of the smoothening pad during the production process, wherein backward extending chambers are formed in the front portion of the smoothening pad, whereas the cross-section perpendicular to the footing of the chamber remains the same along the length of the chamber.

2. A smoothening device for an applicator, the smoothening device comprising a footing and a smoothening pad, wherein a footing comprises a triangular head having openings for integrating the smoothening pad with the footing, and the smoothening pad comprising a front portion having a face, a body made of an elastic material, the smoothening pad being provided on the triangular head of the footing, wherein said body comprises wings formed along the sides of the body with a space between the wings for accumulating excess sealing material, characterised in that a bolster is provided in the front portion of the smoothening pad that is made of a more elastic and softer material than the material used for forming the body of the smoothening pad, or a gap or empty chambers are formed in the front portion of the smoothening pad during the production process, wherein the chambers formed in the front portion of the smoothening pad are divided into sub-chambers by partitions during the production process.

3. The smoothening pad for an applicator according to claim 2, characterised in that the bolster or pad provided in the front portion of the smoothening pad is covered with a layer of a more rigid and harder material.

4. The smoothening pad for an applicator according to claim 2, characterised in that the body of the smoothening pad, the wings, and the bolster in the front portion of the smoothening pad are made of an elastic polymer.

5. The smoothening pad for an applicator according to claim 4, characterised in that the elastic polymer is silicone.

6. The smoothening pad for an applicator according to claim 2, characterised in that the face of the front portion of the smoothening pad imitates a human finger and the body expands backward copying the shape of the head of the footing.

7. The smoothening pad for an applicator according to claim 2, characterised in that the body of the smoothening pad and the wings of the smoothening pad are made of a more rigid material than the bolster or pad in the front portion of the smoothening pad.

8. The smoothening pad for an applicator according to claim 2, characterised in that the gap is formed in the front portion of the smoothening pad that extends to the central portion of the smoothening pad or the footing.

* * * * *